US005201345A

United States Patent [19]

Meskanick et al.

[11] Patent Number: 5,201,345

[45] Date of Patent: Apr. 13, 1993

[54] INFLATABLE CONTAINMENT DIAPHRAGM FOR SEALING AND REMOVING STACKS

[75] Inventors: Gerald R. Meskanick, Elizabeth; David T. Rosso, Pittsburgh, both of Pa.

[73] Assignee: The United States of America as represented by the United States Department of Energy, Washington, D.C.

[21] Appl. No.: 734,993

[22] Filed: Jul. 23, 1991

[51] Int. Cl.[5] ..... F16L 55/10

[52] U.S. Cl. ..... 138/178; 138/93; 138/97; 29/402.03; 15/163

[58] Field of Search ..... 138/89; 90, 91, 93, 138/97, 98, 99, 178; 15/162, 163, 243; 454/4, 27; 29/890.31, 402.03, 402.09, 402.14

[56] References Cited

U.S. PATENT DOCUMENTS

| | | | |
|---|---|---|---|
| 628,726 | 7/1899 | Schultz | 15/162 |
| 1,770,436 | 7/1930 | Shinn | 15/163 |
| 2,804,123 | 8/1957 | Kling | 446/220 |
| 2,889,892 | 6/1959 | Schaub et al. | 138/93 |
| 3,908,682 | 9/1975 | Thompson | 138/93 |
| 4,194,494 | 3/1980 | Wagner | 138/89 |
| 4,250,609 | 2/1981 | Beaudoin | 138/93 |
| 4,335,536 | 6/1982 | Magid et al. | 446/220 |
| 4,437,494 | 3/1984 | Soper et al. | 138/97 |
| 4,624,712 | 11/1986 | Neumann et al. | 15/242 |
| 5,062,207 | 11/1991 | Martin et al. | 29/402.03 |
| 5,113,912 | 5/1992 | Vetter | 138/97 |
| 5,117,763 | 6/1992 | Gustafson | 110/184 |

FOREIGN PATENT DOCUMENTS

| | | | |
|---|---|---|---|
| 4245 | 10/1978 | United Kingdom | 15/162 |
| 1548386 | 7/1979 | United Kingdom | 138/91 |

*Primary Examiner*—James E. Bryant, III

*Attorney, Agent, or Firm*—William M. Imwalle; William R. Moser; Richard E. Constant

[57] ABSTRACT

A diaphragm with an inflatable torus-shaped perimeter is used to seal at least one end of a stack so that debris that might be hazardous will not be released during removal of the stack. A diaphragm is inserted and inflated in the lower portion of a stack just above where the stack is to be cut such that the perimeter of the diaphragm expands and forms a seal against the interior surface of the stack.

5 Claims, 2 Drawing Sheets

INFLATABLE CONTAINMENT DIAPHRAGM FOR SEALING AND REMOVING STACKS

FIELD OF THE INVENTION

The present invention relates generally to a containment diaphragm with an inflatable perimeter. More particularly, a diaphragm with an inflatable perimeter is used to seal the ends of a stack so that debris that might be hazardous will not be released during removal of the stack. This invention is owned by the U.S. Government under DOE contract number DE-AC11-88PN38014.

BACKGROUND OF THE INVENTION

When stacks deteriorate, they can fall over in high wind. The higher the stack, the greater the danger of it falling over once it has deteriorated. Similarly, the higher the stack, the greater the risk of an accident while the stack is being removed.

All stacks at nuclear power plants, and most modern stacks, are made of steel. Over time, they will corrode, particularly at the base. For removal, stacks are cut at the base and then taken down with a crane.

Where the inside of the stack may be contaminated with hazardous materials, it is necessary to contain any debris that might be created during removal. For example, stacks at nuclear facilities may be contaminated with radioactive substances. These stacks can be as high as 100 feet, and therefore have a high risk of falling over while they are being taken down. Since they may contain radioactive debris that can be dislodged during removal or afterwards, it is important to seal the ends as quickly as possible.

The conventional method of removing a stack that may be contaminated is "bagging off." The top of the stack is sealed. Then, a large sleeve is placed over the area to be cut. The sleeve is affixed at its top and bottom, leaving slack. The sleeve has a number of glove ports through which tools can be manipulated to cut the stack. Once the stack has been completely severed, it is lifted with a crane. The sleeve is cut and the slack is used to bag off the cut end of the stack. The stack is guided to a horizontal position on the ground.

This procedure is acceptable for smaller stacks. However, the danger of wind knocking the stack and crane over increases with the size of the stack and the length of time it must be suspended. What is needed is a means for sealing a stack before it is lifted by the crane.

SUMMARY OF THE INVENTION

In accordance with the present invention, a diaphragm with an inflatable torus-shaped perimeter is used to seal the lower end or both ends of a stack. The diaphragm of the invention is inserted into the lower portion of a stack just above where a stack is to be cut. It is then inflated, and the perimeter of the diaphragm expands and forms a seal against the interior surface of the stack. This allows the stack to be cut below the diaphragm, lifted from its foundation, and immediately lowered to a safe position without releasing hazardous debris. The top of a stack may be sealed with the same device.

The diaphragm is comprised of a torus-shaped ring which is the perimeter of a central barrier. The ring, central barrier, and the connection between the central barrier and the ring are impermeable to the substances to be contained.

DETAILED DESCRIPTION OF THE PREFERRED EMBODIMENT

Figure 1:
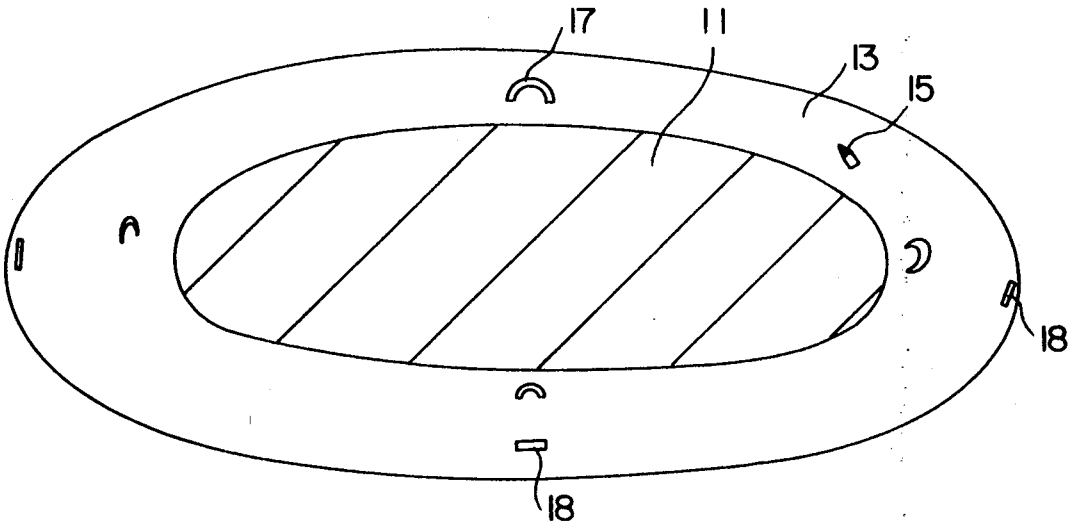
FIG. 1 is an illustration of the inflatable diaphragm.

As can be seen in FIG. 1, the essential parts of the invention are the central barrier 11, the inflatable torus-shaped perimeter 13, and the means for inflating the perimeter 15. Desirably, the central barrier and ring are comprised of a flexible material impermeable to air and to the substances to be contained. In the preferred embodiment, the central barrier and the inflatable periphery are made of polyvinyl chloride film reinforced with canvas. The preferred means of inflating is a tire valve. The perimeter is inflated with compressed air or other inert gas.

To aid in handling, the inflatable perimeter can have attachment loops 17. To facilitate positioning the diaphragm in the stack, magnets 18 may be imbedded in the outermost part of the periphery. The magnets would be of a strength that would hold the weight of the diaphragm in the stack. The need for magnets depends on the diameter and accessibility of the inside of the stack.

Figure 2:
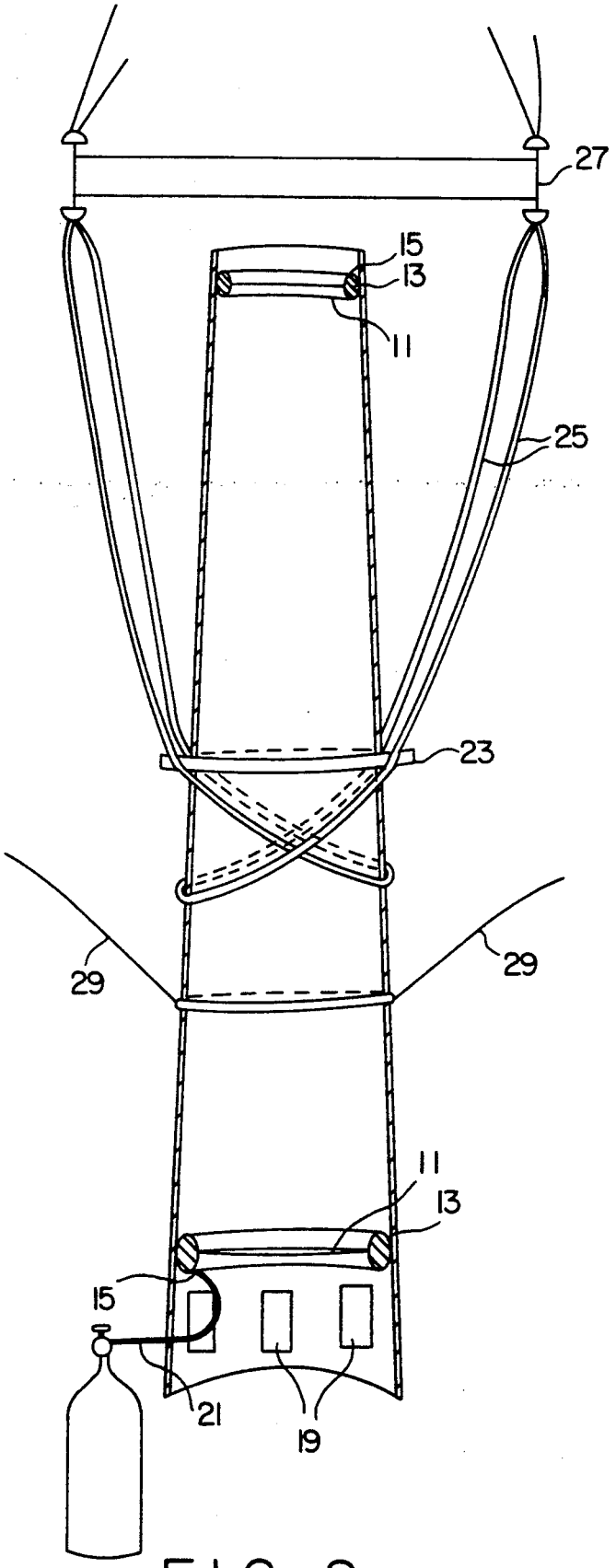
FIG. 2 is a cut-away view of two diaphragms being used in a stack-removal procedure.

The procedure for sealing and removing a stack is illustrated in FIG. 2 and set forth as follows.

Near the bottom of a stack are stack cooling vents 19. These openings allow outside air to be drawn into the stack to cool stack gases and to thereby reduce corrosion. The diaphragm is inserted through one of these vents and positioned above the vents just above the point at which the stack will be cut.

Positioning can be done through the stack cooling vents by hand (with protective clothing) or using poles. Alternatively, the diaphragm can be lowered from the top of the stack using the attachment loops 17. Depending on the technique chosen, partial inflation of the periphery can facilitate positioning. Positioning would be followed by full inflation and the removal of the filling line 21. The top of the stack is also sealed using either a diaphragm with an inflatable perimeter or other suitable means.

Before or after positioning the top and bottom seals, the stack must be secured to a crane (not shown) with brackets 23 attached to slings 25 that are attached to a horizontal spreader beam 27. Once secured, the stack is then cut using a sawzall or other suitable device. Once cut, the stack is removed by the crane and guided by tag lines 29, and the base of the stack is capped. The tag lines are attached between the cut area and the brackets.

What is claimed is:

1. A method for sealing a stack that may contain hazardous substances prior to removal of said stack, comprising:

inserting in the lower portion of the stack just above where the stack is to be cut an inflatable diaphragm, comprising:

a central barrier impermeable to the substances to be contained;

an inflatable torus-shaped ring attached to said central barrier such that the ring is the perimeter of the central barrier, wherein said perimeter is impermeable to the substances to be contained by the diaphragm, and wherein said central barrier and said ring together are impermeable to the substances to be contained;

and a means for inflating said torus-shaped ring;

inflating said diaphragm, whereby the perimeter of the diaphragm expands and forms a seal against the interior surface of the stack; and sealing the top of said stack.

2. The method of claim 1 wherein said means for inflating said torus-shaped ring is a tire valve.

3. The method of claim 1 wherein said torus-shaped ring consists of a flexible, air-impermeable material.

4. The method of claim 3 wherein said torus-shaped ring consists of polyvinyl chloride film covered with canvas.

5. The method of claim 1 wherein sealing the top of said stack comprises inserting a second said diaphragm in the upper portion of the stack just below the top of the stack; and inflating said second diaphragm, whereby the perimeter of the second diaphragm expands and forms a seal against the interior surface of the stack.

* * * * *